US005586526A

United States Patent [19]

Lindquist

[11] Patent Number: 5,586,526

[45] Date of Patent: Dec. 24, 1996

[54] LARGE TWO-STROKE INTERNAL COMBUSTION ENGINE

[75] Inventor: Henning Lindquist, Nivå, Denmark

[73] Assignee: MAN B&W Diesel A/S, Copenhagen SV, Denmark

[21] Appl. No.: 557,193

[22] PCT Filed: Nov. 9, 1993

[86] PCT No.: PCT/DK93/00364

§ 371 Date: Dec. 4, 1995

§ 102(e) Date: Dec. 4, 1995

[87] PCT Pub. No.: WO94/29577

PCT Pub. Date: Dec. 22, 1994

[30] Foreign Application Priority Data

Jun. 4, 1993 [DK] Denmark ..... 0647/93

[51] Int. Cl.[6] ..... F01L 9/02

[52] U.S. Cl. ..... 123/90.12; 91/453

[58] Field of Search ..... 123/90.12, 90.13, 123/445, 446, 495, 500.4, 508, 504; 91/403, 453, 594

[56] References Cited

U.S. PATENT DOCUMENTS

| | | | |
|---|---|---|---|
| 3,968,735 | 7/1976 | Boisde et al. | 91/402 |
| 4,162,614 | 7/1979 | Holleyman | 60/370 |
| 4,664,070 | 5/1987 | Meistrick et al. | 123/90.13 |
| 4,773,301 | 9/1994 | Shimamura et al. | 91/453 |
| 5,287,829 | 2/1994 | Rose | 123/90.12 |

FOREIGN PATENT DOCUMENTS

| | | |
|---|---|---|
| 0134744 | 3/1985 | European Pat. Off. . |
| 0391507 | 10/1990 | European Pat. Off. . |
| 0455937A1 | 11/1991 | European Pat. Off. . |
| 2411196 | 9/1974 | Germany . |
| WO89/03939 | 5/1989 | WIPO . |

OTHER PUBLICATIONS

Derwent's abstract, No. 84–81106/13, week 8413, Abstract of SU, 1023116 15 Jun. 1983.

*Primary Examiner*—Thomas N. Moulis
*Attorney, Agent, or Firm*—Sughrue, Mion, Zinn, Macpeak & Seas

[57] ABSTRACT

An internal combustion engine (1) has hydraulically driven exhaust valves (13) and fuel pumps (18). The hydraulic drives are controlled by means of a computer (16) and electrically activated positioning means (64) setting a spool in a spool valve. If the electronic control of the engine fails, the spool movement may be controlled by a first piston (41) on which the pressure in a hydraulic hose or conduit (48) acts, said conduit extending to a second piston (44) which may follow a cam (26) on a rotating camshaft. The hydraulically driven cylinder members (13, 14, 18) associated with each of the engine cylinders are mounted at the pertaining cylinder, whereas the camshaft (23) independently of the positioning of the cylinder members is disposed at an appropriate shaft drive, such as the crankshaft (11). The cam shaft has a very short length and small mass and may for instance be disposed at one end of the engine.

10 Claims, 5 Drawing Sheets

LARGE TWO-STROKE INTERNAL COMBUSTION ENGINE

Figure 1:
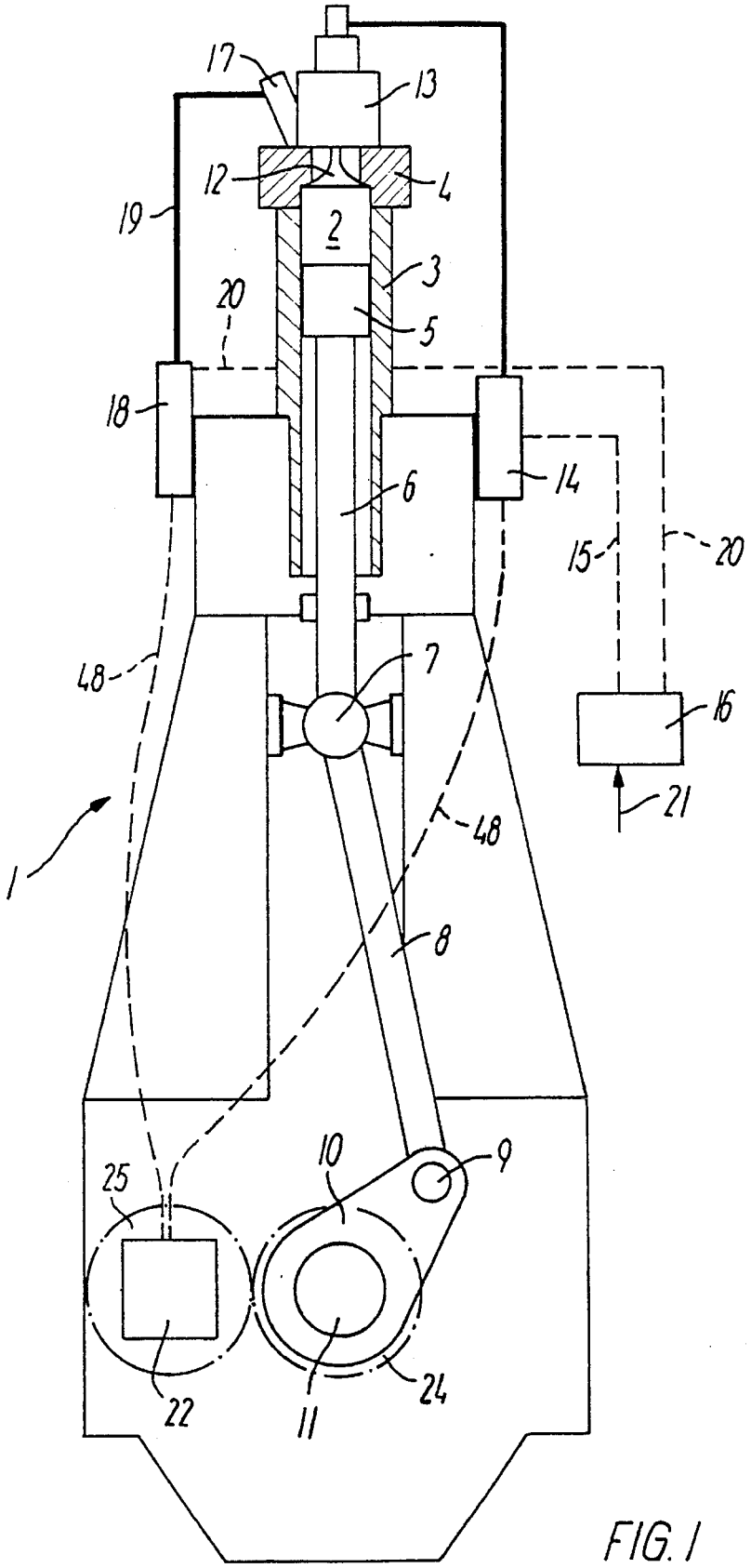

The invention relates to a large two-stroke internal combustion engine, in particular a main engine of a ship, having a hydraulically driven cylinder member, such as a fuel pump or an exhaust valve, in which the hydraulic drive of the member comprises a driving piston journalled in a hydraulic cylinder which, through a flow passage, communicates with a spool valve, the spool of which may occupy a position where the flow passage communicates with a high pressure source for hydraulic oil, and another position, where the flow passage communicates with a low pressure port, where during normal engine operation, the spool is positionable by means of an electrically activated positioning means receiving control signals from an engine controlling computer, and where, in case of failure of the normal engine control, the spool is alternatively positionable by means of a camshaft rotating synchronously with the crankshaft of the engine.

Such an internal combustion engine is known from for example international patent publication No. WO89/03939, where the camshaft is of the conventional type whose cam acts directly on a rod connected with the spool or acts on a secondary spool mounted on the spool housing. The publication also indicates that between the cam and the rod connected with the spool, a transversely movable rod may be inserted having an idler contacting the cam, which makes it possible to change the timing of the cam action on the control spool.

In the known engines, the camshaft is positioned immediately below the cylinder members to be activated by the cams. The camshaft extends in the full longitudinal direction of the engine to be able to act on the cylinder members of all the cylinders. In consequence of its length, the camshaft has a large mass and is relatively expensive to manufacture, just as it uses a deal of energy, as it participates in the movements of the crankshaft. To ensure a synchronous movement of the camshaft in relation to the crankshaft, the two shafts are connected by means of a chain drive, which may have a mass of several tonnes in a large internal combustion engine. The bearings and cams of the camshaft further have to be lubricated, which requires designing of oil ducts and lubricating oil pumps, etc., for the camshaft.

The purpose of the invention is to simplify the engine by providing a small camshaft which may be mounted at a distance from the cylinder members activated by the camshaft.

With this in view, the internal combustion engine according to the invention is characterized in that the spool is associated with a first piston on which the pressure in a hydraulic conduit acts, said conduit extending to a second piston which may follow a cam on the rotating camshaft, and that the hydraulically driven cylinder members associated with each of the engine cylinders are mounted at the pertaining cylinder, whereas the camshaft independently of the positioning of the cylinder members is disposed at an appropriate shaft drive, such as the crankshaft.

The spool valve only requires a relatively small force to activate the hydraulically driven cylinder member, which permits the hydraulic hose or conduit interconnecting the first and the second piston to have such a small internal diameter that the amount of hydraulic oil in the conduit will not be very large, even if the conduit is of great length. It is therefore possible to obtain an accurate transmission of the movements of the second piston to the first piston, even though the camshaft is positioned at a large distance from the cylinder members. The hydraulic conduits with the associated pistons act as a rigid push rod, even though there is a vertical and horizontal distance of many meters between the positions of the first and the second piston. The hydraulic force transmission between the two pistons associated with each cylinder member therefore permits the camshaft to be disposed at any suitable shaft drive. It is, for example, possible to position the camshaft at the end of the engine in direct toothed engagement with the crankshaft. The camshaft may also be disposed as an extension of the shaft driving the cylinder lubricating devices. All the pistons driven by the camshaft with associated connections for the hydraulic conduits may be arranged closely next to each other in a single unit, so that the camshaft has an extremely short length and thus small mass. The energy consumption for driving the camshaft will therefore be a minimum and quite negligible in relation to the total energy consumption of the engine, which increases the efficiency of the engine. The previously known large chain drive and the elongated housing for the camshaft also completely disappears, which gives a marked reduction of the total weight of the engine and makes the manufacture of it cheaper.

As the camshaft with the associated hydraulic push rods is only a mechanical emergency control system for use in case of failure in the electronic engine control, during normal engine operation the first piston is preferably prevented from transmitting the cam movement to the spool, whereby the spool and the electronic control system remain uninfluenced by the mechanical emergency control system during normal engine operation.

With a view to reducing the energy consumption of the engine, but at the same time keep the mechanical emergency control system ready for immediate operation, a preferred embodiment is characterized in that the second piston is lifted free of the camshaft when the engine control is normal, and that the second piston is brought into contact with a cam on the camshaft, when the latter is to be engaged. During normal operation, the camshaft is thus uninfluenced by the second piston associated with each cylinder member, so that no energy is delivered to the hydraulic conduits interconnecting the first and the second pistons. The first piston for each cylinder member thus stands still during normal engine operation and thus cannot transmit cam movements to the spool. Lifting the second piston off the camshaft renders it possible to keep the hydraulic conduit between the two pistons filled with hydraulic oil, so that the emergency control system may be engaged in a fraction of an engine cycle, if a failure occurs in the electronic engine control. However, as an alternative to the lifting off of the second piston, it is possible to deactivate the camshaft control by opening a puncture valve in the hydraulic conduit, but this involves a risk of air penetrating into the hydraulic conduit, which will destroy an accurate camshaft control.

The amount of oil in the hydraulic conduits may further be reduced by adapting the spool to follow the movements of a small pilot spool which is controlled during normal operation by the electrically activated positioning means and alternatively by the movements of the first piston. The force needed for setting the pilot spool is substantially smaller than the force for setting the spool which regulates the oil flow to and from the driving piston, and the use of a pilot spool thus renders it possible for the first and the second piston to be given very small dimensions, and for the internal diameter of the hydraulic conduits to be only a few millimeters. This contributes towards making the amount of oil in the hydraulic conduit so small that the hydraulic push rod becomes very fast-acting and has a very small energy consumption. The mechanical action of the second piston on the associated cam also becomes very slight, and thus the camshaft may be designed with very small dimensions.

A structurally particularly simple embodiment is characterized in that the pilot spool is positioned coaxially inside the spool and is fastened to a rod which is rigidly connected to the movable part of the positioning means and projects to one side of the spool, and that the first piston is positioned to the other side of the spool and carries a rod which extends coaxially with the spool to the pilot spool.

To prevent any contact during normal engine operation between the emergency control and the pilot spool, the first piston with the associated rod is suitably spring-loaded for movement away from the pilot spool. The spring loading also ensures an accurate return of the first piston, when the camshaft control is activated, and the second piston follows a declining cam profile.

Preferably, the movable part with associated rod of the positioning means is spring-loaded for movement towards the first piston, and during normal engine operation the positioning means overcomes the spring loading. In case of failure in the electronic engine control, the spring loading of the movable part of the positioning means results in the pilot spool immediately being pushed over to abut on the rod connected with the first piston, so that the camshaft immediately takes over the continued engine control. If, before the failure of the electronic control, the second piston abuts on the camshaft, the engine will be substantially unaffected by the failure. In the cases where the second piston first has to be brought into abutment with the associated cam, the engagement of the emergency control will be delayed by the engagement time of the piston.

Owing to the short length of the camshaft, the hydraulic conduits for the cylinder members of the different cylinders have a varying length. The oil in the hydraulic conduits has a certain absolute compressibility depending on the amount of oil in the conduits. If the conduits contain different amounts of oil, the camshaft movement will be transmitted most rapidly to the first piston of the conduits which contain least oil, i.e. the short conduits. It is possible to compensate for this by turning the cams associated with the short conduits a little back on the camshaft, but it is simpler to design the engine so that at least some of the piston-connecting hydraulic conduits leading to the same kind of cylinder members are in communication with a respective compensating volume of a size so that the hydraulic conduits contain a substantially equal amount of hydraulic oil.

The camshaft has to be able to control the engine, both during forward running and reverse running. As the fuel injection and the opening of the exhaust valve are normally not initiated when the piston is exactly in its top dead centre position, but is displaced a few degrees in relation to this, a cam timed for running forward will not give the correct timing in case of reverse running. From the above international patent application it is known that the timing may be changed by displacement in relation to the cam of an idler mounted on a transversely movable rod. A suitable further development of this prior art is characterized in that in its active position, the second piston abuts on the upper side of a rod which on its lower side carries an idler contacting the associated cam, that the rod is transversely movable in relation to the longitudinal direction of the camshaft between an extreme position for use during running of the engine in the normal direction of rotation, and another extreme position for use during running of the engine in the opposite direction of rotation.

By letting the rod be movable between two extreme positions for use at forward running and reverse running, respectively, the rod may be controlled in a very simple manner, for example by means of a compressed-air cylinder forcing the rod to be either in one or the other extreme position. To obtain the correct timing of fuel pumps and exhaust valves it is thus only necessary to shift a single control valve for the pneumatic cylinder.

The two extreme positions of the rod are suitably adjustable, so that the timing may be adjusted in relation to the actual engine load. The extreme positions may, for example, be fixed by means of two manually adjustable, mechanical stops. In case of operation of long duration at a certain engine load, the operating staff may adjust the stops by means of an instruction showing the relationship between the engine load and the optimum position for the stops.

Figure 2:
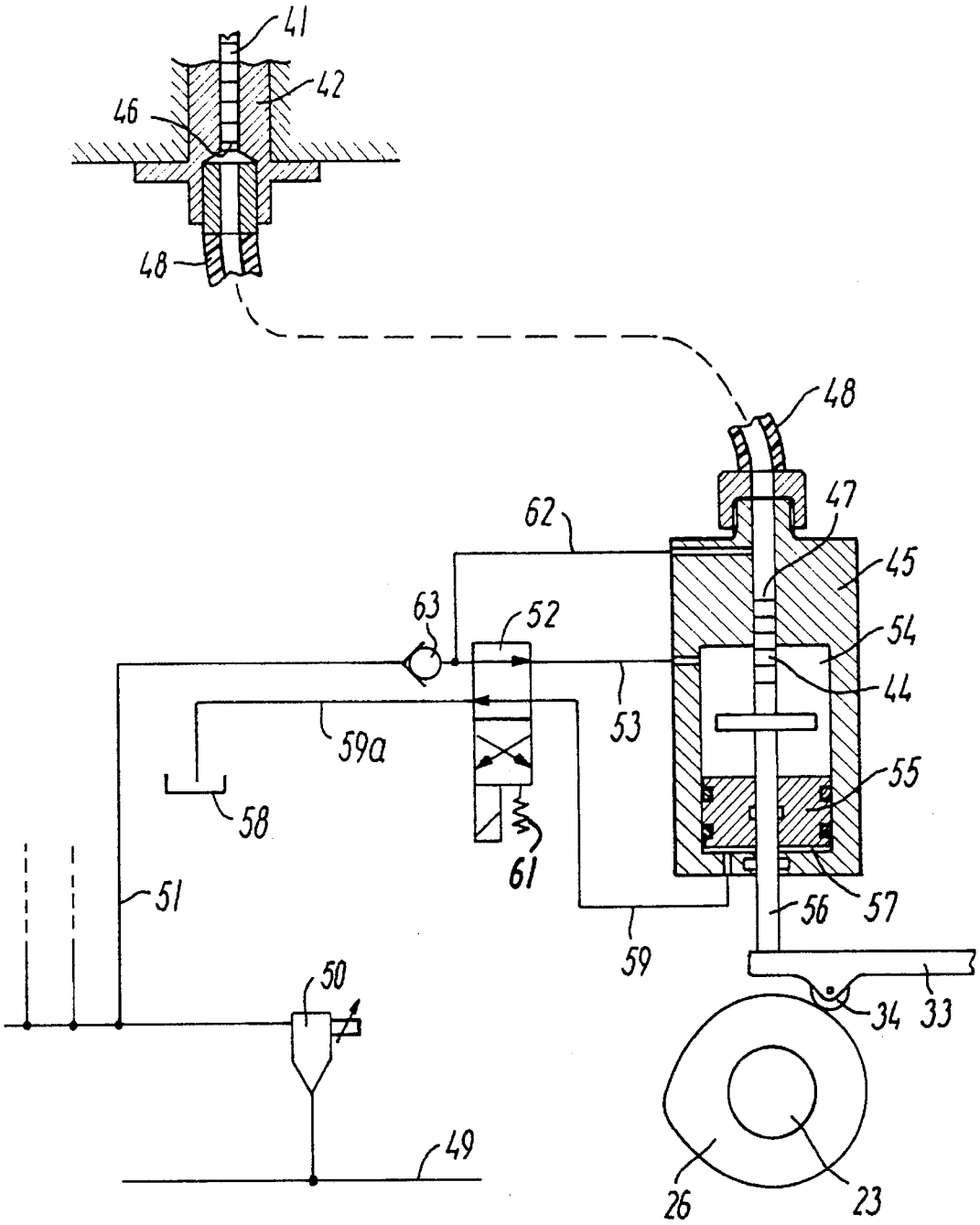
Figure 3:
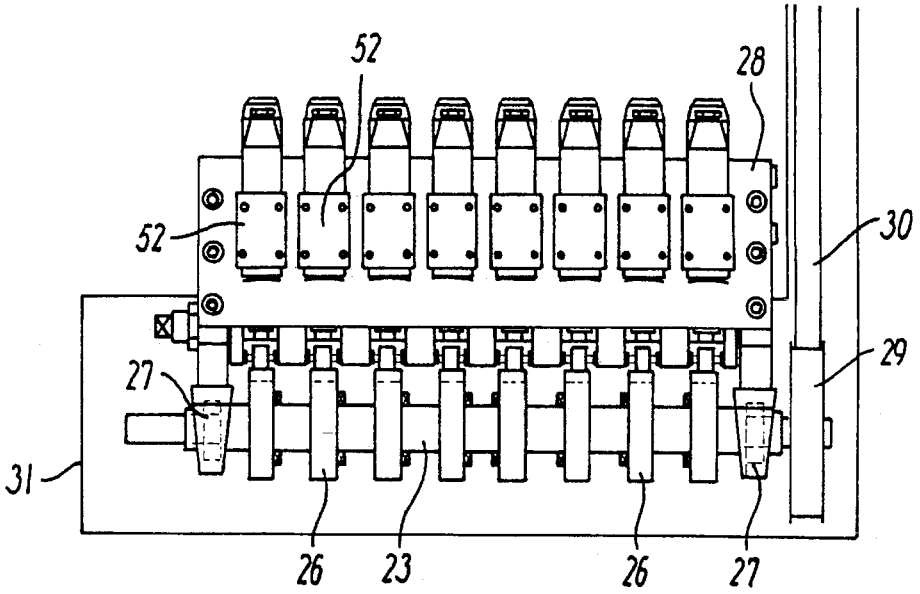
Figure 4:
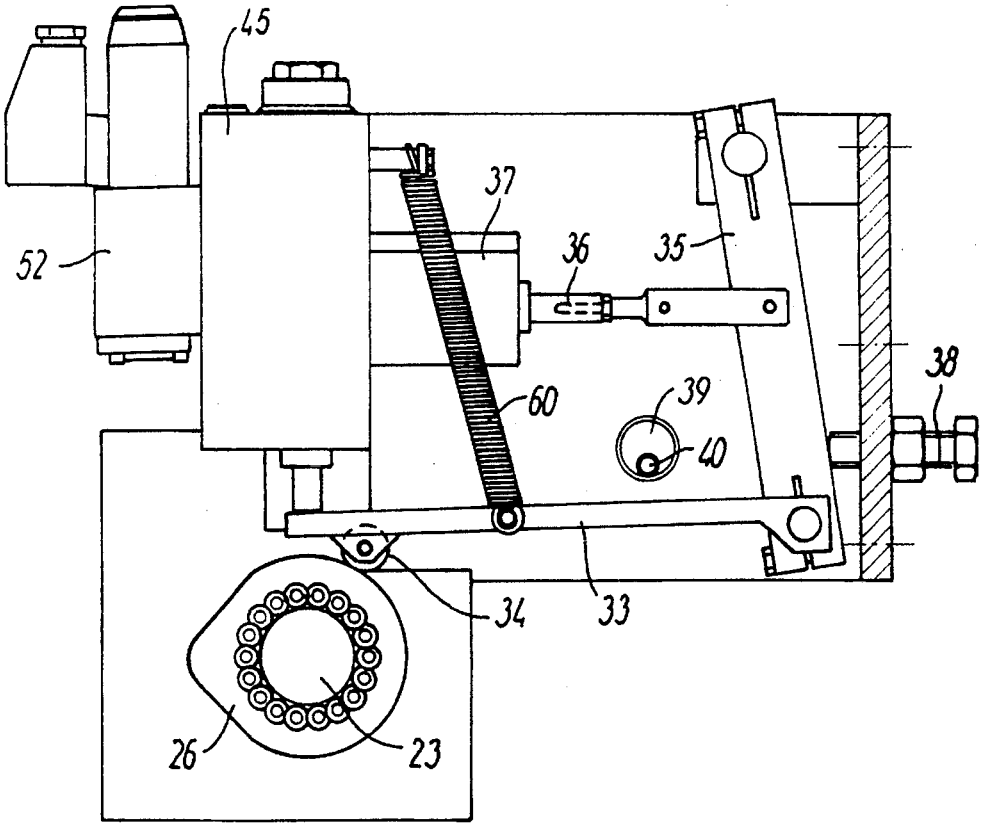
Figure 5:
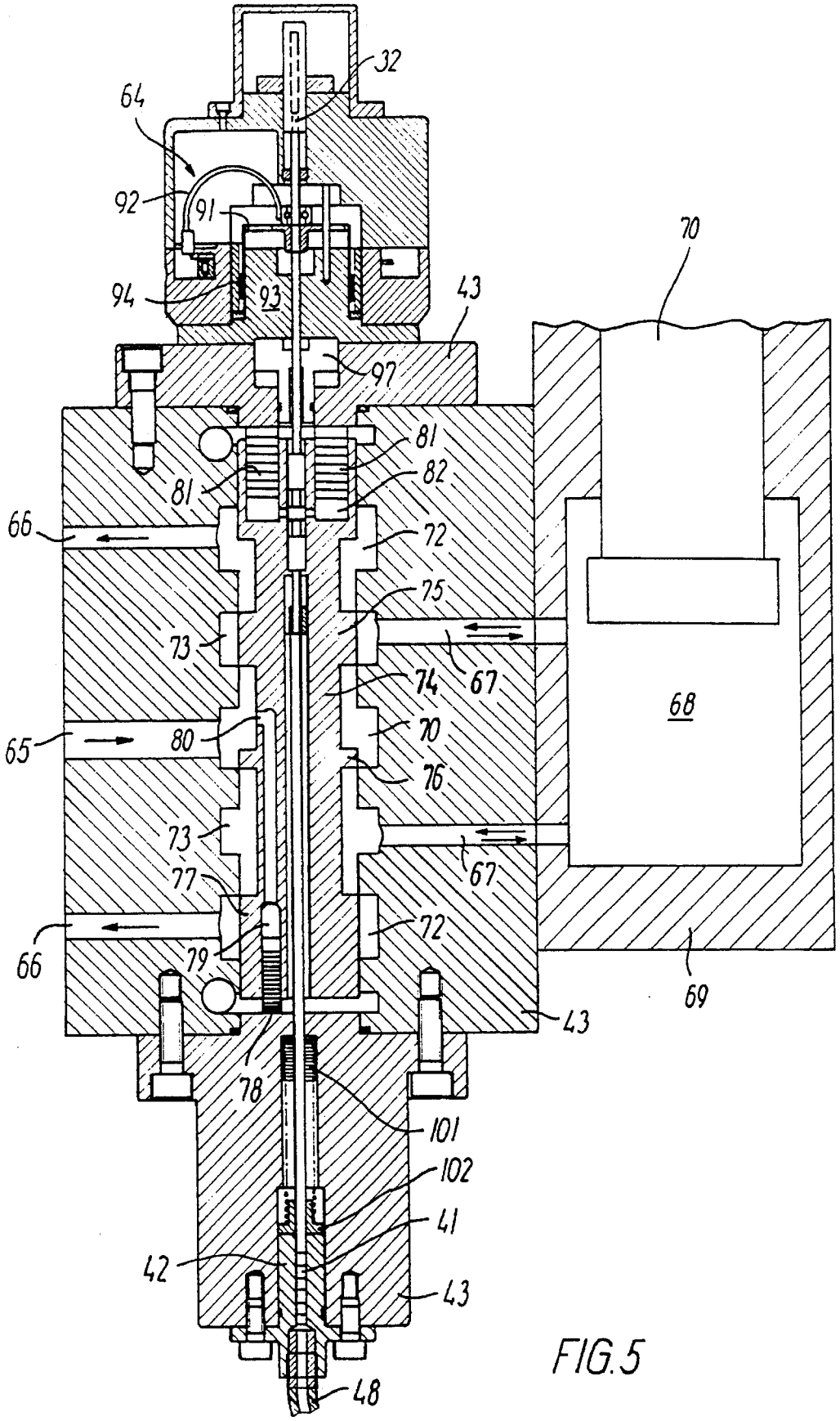

An example of an embodiment of the invention will be described in further detail below with reference to the very schematic drawings, in which FIG. 1 shows an outline of an internal combustion engine, FIG. 2 is a diagram of the hydraulic connections to an emergency control system for the engine, FIG. 3 is a side view of a camshaft for the engine of FIG. 1, FIG. 4, on a slightly larger scale, an end view of the camshaft shown in FIG. 3 with associated equipment for adjusting the timing, FIG. 5 is a longitudinal sectional view through a spool valve for a cylinder member, and FIG. 6, on a larger scale, a segment of the spool valve of FIG. 5.

FIG. 1 shows a large two-stroke diesel engine of the crosshead type generally designated 1, which may be used as the main engine of a ship or as a stationary power-producing engine. The combustion chamber 2 of the engine is delimited by a cylinder liner 3 and a cylinder cover 4 and a piston 5 journalled in the liner.

Via a piston rod 6, the piston is directly connected with a crosshead 7 which, via a connecting rod 8, is directly connected with a connecting rod pin 9 in a throw 10 of a crankshaft 11. A cylinder member in the form of an exhaust valve 12 with associated housing 13 is mounted on the cover 4. The exhaust valve is activated by a hydraulic drive 14 controlled by an electro-mechanical valve activated by control signals transmitted through a wire 15 from a computer 16.

A fuel valve 17 mounted in the cover 4 may supply atomized fuel to the combustion chamber 2. Another cylinder member in the form of a fuel pump 18 is controlled by an electro-mechanical valve and may supply fuel to the fuel valve through a pressure conduit 19 in dependency of control signals received from the computer 16 through a wire 20. Through a signal-transmitting wire 21, the computer 16 is supplied with information on the current number of revolutions per minute of the engine. The number of revolutions may either be taken from the tachometer of the engine, or it may originate from an angle detector and indicator mounted on the main shaft of the engine and determining the current angular position and rotating speed of the engine for intervals constituting fractions of an engine cycle of a shaft rotation of 360°. When the computer has determined the time for the fuel injection and the associated amount of fuel, and the opening and closing times of the exhaust valve, the fuel pump 18 and the drive unit 14 are activated accordingly at the moment of the engine cycle which is correct for the cylinder. The engine has several cylinders which are all equipped in the above manner, and the computer 16 may control the normal operation of all cylinders.

As explained below, the oil inflow and outflow for the hydraulic drives of the cylinder members are controlled by a spool valve (or shuttle or slide valve), which is set during normal engine operation by an electrically activated positioning means reacting on control signals from the computer 16. If, for some reason, a failure occurs in the electronic control system, the setting of the spool (or shuttle or slide) is taken over by a camshaft control system. This control system comprises a camshaft unit 22 with a camshaft 23 rotating synchronously with the crankshaft 11 of the engine, for example, by the two shafts being in mutual engagement through two cogwheels 24 and 25. The camshaft unit may be disposed at the end of the engine, but may also, as indicated, be disposed at a suitable place inside the engine. If it is not desired that the camshaft unit is in immediate proximity to the crankshaft, the synchronization of the camshaft may alternatively be provided via a chain or belt drive.

The camshaft unit will now be described in further detail with reference to FIGS. 2–4. The camshaft unit shown is intended for an engine with four cylinders, each having two hydraulically driven cylinder members. Thus, the camshaft has eight cams 26 in close proximity to each other, so that the shaft has a short length. As a consequence of the small size of the camshaft, it is sufficient to journal it in two bearings 27 carried by the camshaft housing 28. By means of a belt pulley 29 and a toothed belt 30 the camshaft is driven synchronously with the crankshaft. The camshaft is enclosed by a protective casing 31. The forces acting on the camshaft are so small that the bearings 27 need only be grease-lubricated, and the cams on the shaft can do without lubrication. The previously known camshaft lubricating systems may be omitted completely.

The timing of each cam 26 in relation to the engine cycle takes place by means of a rod 33 which abuts the cam periphery via an idler 34. At the end away from the shaft, the rod 33 is journalled on an upright top-hung intermediate rod 35 which, at a distance from its upper journalling point, is connected with a piston rod 36 in a pneumatic cylinder 37. The cylinder 37 may move the intermediate rod 35 and thus the rod 33 between two extreme positions determined by two stops in the form of a set screw 38 and an eccentrically journalled disc 39. The extreme positions are settable by turning the screw 38 and by turning the disc 39 about its fulcrum 40, respectively. Adjustment of the extreme positions leads to a change of the point of contact of the idler 34 on the cam 26, whereby the raising and lowering of the rod 33 produced by the cam is phase displaced in relation to the rotational movement of the camshaft. In the extreme position shown, with the intermediate rod 35 abutting the set screw 38, the camshaft unit is set for forward running, while the camshaft unit with the intermediate rod 35 abutting the disc 39 is intended for reverse running.

When the camshaft control is active, a first piston 41 acts on the spool of the spool valve of the associated cylinder member. The piston 41 is journalled in a small hydraulic cylinder 42 mounted at the end of the spool valve housing 43.

The movements of the first piston are controlled by a second piston 44 journalled in a small hydraulic cylinder 45 in the camshaft unit. The end surface 46 of the first piston and the end surface 47 of the second piston are in direct contact with the oil in a hydraulic conduit 48, the two ends of which are connected to the cylinders of the first and the second piston, respectively. The hydraulic pressure hose or conduit 48 is bendable and flexible which makes its installation very easy. The flexibility of the hydraulic conduit 48 permits the camshaft unit 22 to be disposed at a large distance from the hydraulically driven cylinder members both in the horizontal and the vertical direction, as roughly outlined in FIG. 1 by the dotted lines 48. To obtain an accurate and uniform transmission of the movement of the second piston to the first piston, it is important that the amount of oil in the conduit 38 is constant, and that the conduit is filled all the time.

The oil for the camshaft control may suitably be taken from a pressure conduit 49 supplying high-pressure hydraulic oil to the hydraulic drives of the cylinder members. As the pressure of this conduit is at about 300 bar, the pressure is reduced in an adjustable pressure reducing valve 50 to about 10–15 bar, which is fully sufficient to ensure an accurate transmission of the movements of the pistons. Via a pressure conduit 51, the oil drain of the pressure reducing valve communicates with a valve 52 which may occupy two positions. In the active position shown in FIG. 2, the conduit 51 is connected to a conduit 53 leading to a pressure chamber 54 on the upper side of a lifting piston 55 which is pressed down at the bottom of the chamber 54 so that a projecting collar on the piston 44 is positioned at a distance from the upper side of the piston 55. The oil pressure in the conduit 48 presses the second piston 44 and a pressure rod 56 rigidly connected with it down for abutment against the upper side of the rod 33, so that the second piston is forced to closely follow the cam profile. Simultaneously, the valve 52 keeps a pressure chamber 57 on the lower side of the lifting piston 55 in connection with a drain 58 via a conduit 59, **59*a*. The piston 44 and the pressure rod 56 suitably have the same diameter, so that the pressure in the chamber 54 does not yield any resulting force on the projecting collar of the piston 44**.

The camshaft unit may be deactivated by switching the valve 52 so that the pressure chamber 54 is put into communication with the drain 58, and the pressure chamber 57 is put into communication with the pressure conduit 51, the result of which is that the second piston with associated pressure rod 56 is lifted free of the cam 26, because the lifting piston 55 is moved upwards in the chamber 54 and hits the lower side of the collar on the piston 44, whereupon the piston participates in the upward movement of the lifting piston. A branch conduit 62 debouching above the piston 44 is put into connection with the pressure chamber 57 at the valve switching, so that the lifting of the second piston 44 does not influence the position of the first piston 41. Simultaneously with the lifting, the rod 33 is lifted free of the cam by means of a spring 60. When the chamber 54 is pressurized, the downward force on the pressure rod 56 is far greater than the spring load on the rod 33.

By a spring 61, the valve 52 is preloaded to the position where the camshaft control is disengaged, to ensure that the second piston 44 does not come into engagement with the cam after a standstill of long duration. A nonreturn valve 63 ensures that the hydraulic conduit 48 with associated conduits and pressure chambers 54, 57 is always kept filled with oil.

FIG. 5 shows how the first piston 41 with associated cylinder 42 is mounted at the end of the spool valve housing 43, which is composed of several pieces bolted together, viz. a central piece and two end covers, where the first piston is mounted in one end cover, while an electrically activated positioning means 64 is mounted on the other end cover.

The central piece of the housing has a fluid inlet conduit 65 communicating with the high-pressure conduit 49, two fluid drain conduits 66 communicating with a low-pressure port, and two outlet conduits 67 leading to a pressure chamber 68 in a hydraulic cylinder 69 for the hydraulic drive driving the cylinder member. A hydraulic piston 70 in the drive is driven upwards by the oil pressure in the chamber 68 when the latter is connected with the inlet conduit 65. When the chamber 68 is connected with the drain conduit 66, the piston 70 may be returned to the starting position by means of hydraulic or pneumatic pressure on a piston face, not shown.

The conduit 65 opens out in a circumferential groove 70 which is consequently pressurized. Similarly, the drain conduits 66 communicate with a respective circumferential groove 72, and the outlet conduits 67 communicate with a respective circumferential groove 73. A spool 74 positioned centrally in the housing is shown in its neutral position where a circumferential flange 75 on the spool exactly bars the groove 73 and thus cuts off the outlet conduit 67 topmost on the drawing from both the drain conduit 66 and the inlet conduit 65. Similarly, the bottom outlet conduit 67 is cut off from the inlet conduit 65 by means of another circumferential flange 76 on the spool and is cut off from the drain conduit 66 by means of a third circumferential flange 77 on the spool.

When the spool is moved from its neutral position towards the positioning means 64, the inlet conduit 65 is put into communication with the two outlet conduits 67, and when the spool is moved from its starting position towards the first piston 41, the drain conduits 66 are put into connection with the two outlet conduits 67.

Two piston members 78, of which only one is shown in the drawing, abut on the end cover containing the first piston member and project into a respective axially extending bore 79 which communicates continuously with the inlet conduit 65 via a pressure conduit 80. Two piston members 81 abut on the opposite end cover and project into axially extending bores 82 in the opposite end of the spool. The piston members 81 and the associated bores 82 have a substantially larger diameter than the piston members 78 and their associated bores 79.

Figure 6:
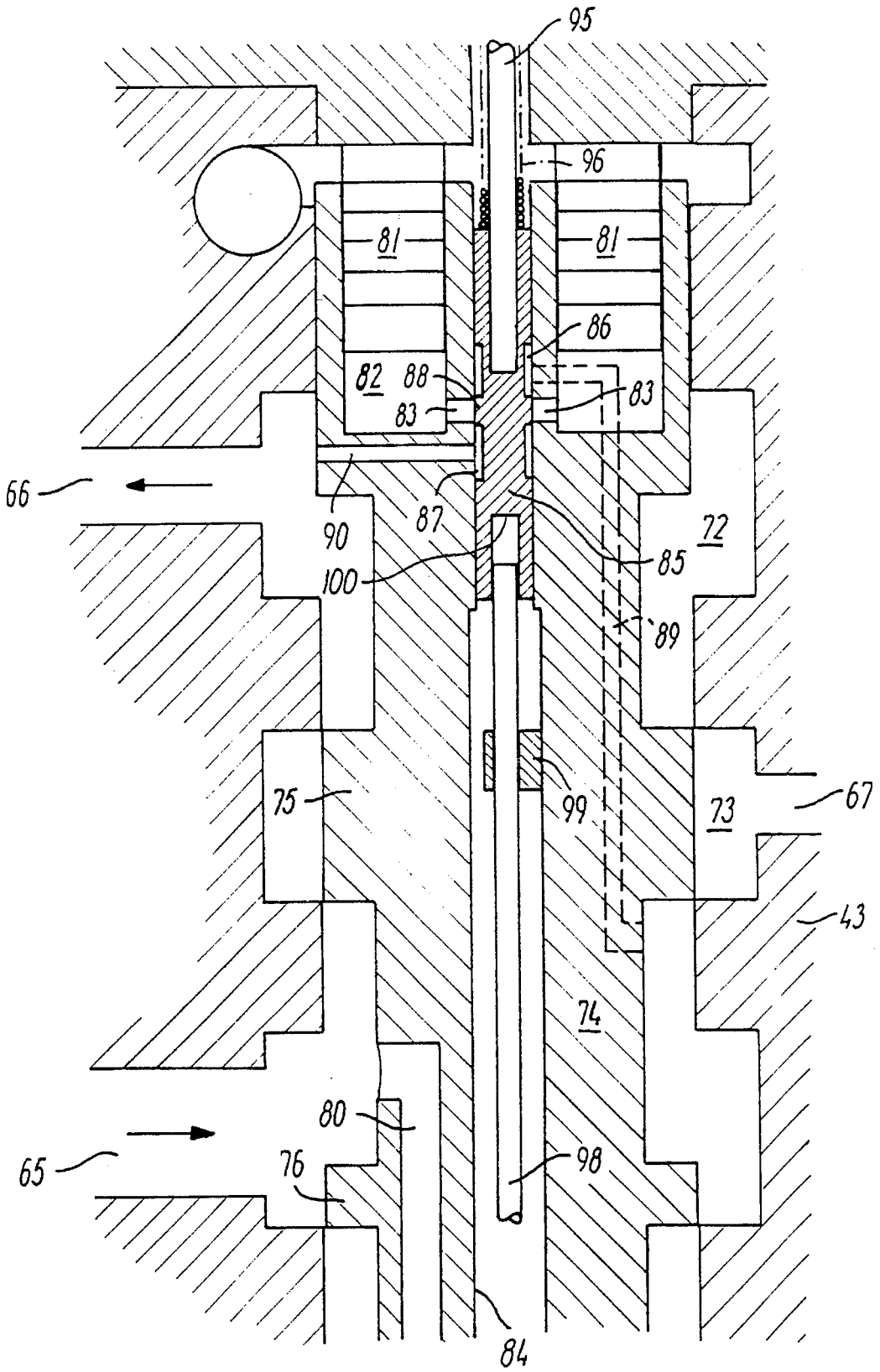

FIG. 6 shows that a transverse conduit 83 from each bore 82 opens out into a central longitudinal bore 84 in the spool. The bore 84 is through-going in the full length of the spool, and a small pilot spool 85 is inserted in the bore. Two circumferential grooves 86 and 87 have been so incorporated in the peripheral surface of the pilot spool that a flange 88 positioned centrally between the grooves has a width exactly corresponding to the width of the transverse conduits 83. The groove 86 communicates continuously with the inlet conduit 65 through a pressure conduit 89. Through a drain conduit 90, the groove 87 communicates continuously with the drain conduit 66. In the position shown, the pilot spool is in its neutral position, where the central flange 88 cuts off the transverse conduits 83 from connection with both the pressure conduit 89 and the drain conduit 90.

The electrically controlled positioning means 64 is designed according to the linear motor principle, where a movable part 91 carries a number of windings connected with two freely bendable wires 92. The windings are positioned between an iron-based core material 93 and a strong, cylinder-shaped magnet 94. When current is passed through the windings via the wires 92, the movable part 91 is immediately put into motion, where the direction and speed of movement depends on the direction and intensity of the current. The movable part is associated with a position sensor 32 which emits signals to the computer concerning the actual position of the movable part. The movable part 91 is rigidly connected with the pilot spool 85 via a rod 95 positioned coaxially with the spool 74. A relatively weak compression spring 96 positioned coaxially around the rod 95 abuts the end surface of the pilot spool and an oppositely directed surface on a centring piece 97 positioned between the end cover 43 and the core material 93.

The first piston 41 is rigidly connected with a rod 98 extending coaxially with the spool 74 into the central bore 84 of the latter, in which bore the rod is centred by means of a trilobate guide member 99. When the camshaft control is inactive, the end of the rod 98 is positioned at a suitable distance from a corresponding abutment surface 100 on the pilot spool, so that the latter is unaffected by the presence of the rod 98. The computer 16 performs a running monitoring and fine setting of the movable part 91 and thus counteracts the pressure from the spring 96. If the electronic control fails, the spring 96 will press the pilot spool along to abutment against the rod 98, and simultaneously the valve 52 is switched, so that the cam movement is transmitted through the second piston 44, the hydraulic conduit 48, the first piston 41 and the rod 98, which then positions the pilot spool 85 in the correct manner. A compression spring 101 acts on the first piston member through a collar 102 mounted on the rod 98 for movement towards the hydraulic conduit 48. This gives extra security for the first piston member 41 rapidly following a downward movement of the other piston member 44, when the idler 34 follows the declining side of the cam.

Now, the functioning of the spool valve will be described. As mentioned, there is a continuous pressure in the bore 79, which yields a permanent force in the upward direction on the drawing on the spool 74. When the pilot spool stands still, it is possible that this upward force will displace the spool in the upward direction. If this happens, the transverse conduits 83 are put into communication with the pressure conduit 89, so that pressurized oil flows into the bores 82. The consequent pressure increase in the chamber in front of the piston members 81 acts on the spool with a force which is directed downwards and forces the spool to occupy the position in which the central flange 88 of the pilot spool exactly bars the transverse conduits 83. If the pressure in the bores 82 becomes too great, the spool is moved a fraction downwards, thus putting the transverse conduits 83 into communication with the drain conduit 90, so that the overpressure in the bores 82 is relieved to the level of balance, where the upward and downward forces on the spool have the same magnitude.

It is seen from this that the spool 74 will always rapidly set itself in the position where the central flange bars the transverse conduits 83. As the bores 82 have a larger diameter than the bores 79, there will always be a resulting force on the spool, if it does not occupy the above neutral position in relation to the pilot spool. When the pilot spool is displaced in the axial direction of the spool by influences from either the rod 95 or the rod 98, the spool 74 will immediately participate in this movement for the above reasons. The small mass of the pilot spool and the associated rods causes the setting forces on the spool to be extremely small, and makes the spool act very rapidly.

It is, of course, possible to let the first piston 41 act directly on the spool 74, but this gives a system which acts more slowly and leads to larger control forces with consequent larger energy deposition in the hydraulic conduit 48.

The camshaft control may be activated for the cylinders individually or simultaneously for all cylinders, dependent on the kind of failure in the electronic control system.

The invention may also be used in connection with other types of electrically activated positioning means, such as solenoids and step motors.

Near the connection for the hydraulic conduit 48 or in said connection, the cylinder 45 for the second piston or the cylinder 42 for the first piston may have a compensating volume of a size so that the hydraulic conduits leading to the same kind of cylinder members contain substantially the same amount of hydraulic oil. This compensating volume may, for example, be provided by drilling a hole of a larger diameter into the connecting branch for the hydraulic conduit or by drilling a transverse conduit into the cylinder and plugging the conduit at such a distance from the central outlet conduit of the cylinder that the total amount of oil between the two pistons is the same for the connected pairs of pistons.

I claim:

1. A large two-stroke internal combustion engine (1), in particular a main engine of a ship, having a hydraulically driven cylinder member, such as a fuel pump (18) or an exhaust valve (13), in which the hydraulic drive of the member comprises a driving piston (70) journalled in a hydraulic cylinder (69) which, through a flow passage 67, communicates with a spool valve, the spool of which (74) may occupy a position where the flow passage (67) communicates with a high-pressure source (65) for hydraulic oil, and another position where the flow passage communicates with a low-pressure port (66), and where, during normal engine operation, the spool is positionable by means of an electrically activated positioning means (64) receiving control signals from an engine controlling computer (16), and where, in case of failure of the normal engine control, the spool is alternatively positionable by means of a camshaft (23) rotating synchronously with the crankshaft (11) of the engine, characterized in that the spool (74) is associated with a first piston (41) on which the pressure in a hydraulic conduit (48) acts, said conduit extending to a second piston (44) which may follow a cam (26) on the rotating camshaft, and that the hydraulically driven cylinder members (14, 13, 18) associated with each of the engine cylinders are mounted at the pertaining cylinder, whereas the camshaft (23) independently of the positioning of the cylinder members is disposed at an appropriate shaft drive, such as the crankshaft (11).

2. An internal combustion engine according to claim 1, characterized in that during normal engine operation, the first piston (41) is prevented from transmitting the cam movement to the spool (74).

3. An internal combustion engine according to claim 2, characterized in that the second piston (44) is lifted free of the camshaft (23) when the engine control is normal, and that the second piston is brought into contact with a cam (26) on the camshaft, when the latter is to be engaged.

4. An internal combustion engine according to claim 1, characterized in that the spool (74) is adapted to follow the movements of a small pilot spool (85) which is controlled by the electrically activated positioning means (64) at normal operation, and alternatively by the movements of the first piston (41).

5. An internal combustion engine according to claim 4, characterized in that the pilot spool (85) is positioned coaxially inside the spool (74) and is fastened to a rod (95) which is rigidly connected to the movable part (91) of the positioning means and projects to one side of the spool, and that the first piston (41) is positioned to the other side of the spool and carries a rod (98) which extends coaxially with the spool to the pilot spool.

6. An internal combustion engine according to claim 5, characterized in that the first piston (41) with the associated rod (98) is spring-loaded for movement away from the pilot spool (85).

7. An internal combustion engine according to claim 5, characterized in that the movable part (91) of the positioning means with associated rod (95) is spring-loaded for movement towards the first piston (41), and that during normal engine operation the positioning means (64) overcomes the spring loading.

8. An internal combustion engine according to claim 7, characterized in that at least some of the piston-connecting hydraulic conduits (48) leading to the same kind of cylinder members, are communicating with a respective compensating volume of a size so that the hydraulic conduits contain a substantially equal amount of hydraulic oil.

9. An internal combustion engine according to claim 1, characterized in that in its active position, the second piston (44) abuts the upper side of a rod (33) which on its lower side carries an idler (34) contacting the associated cam (26), that the rod (33) is transversely movable in relation to the longitudinal direction of the camshaft between an extreme position for use during running of the engine in the normal direction of rotation, and another extreme position for use during running of the engine in the opposite direction of rotation.

10. An internal combustion engine according to claim 9, characterized in that the two extreme positions of the rod (33) are adjustable.

* * * * *